US008847793B2

(12) United States Patent
Ridenour et al.

(10) Patent No.: US 8,847,793 B2
(45) Date of Patent: Sep. 30, 2014

(54) SYSTEMS AND METHODS USING MULTIPLE ZONES OF DETECTION AS A FUNCTION OF ACCURACY

(75) Inventors: Richard D. Ridenour, Glendale, AZ (US); Robert G. Brewer, Pheonix, AZ (US); Christopher W. Lowe, Glendale, AZ (US)

(73) Assignee: Aviation Communication & Surveillance Systems LLC, Phoenix, AZ (US)

( * ) Notice: Subject to any disclaimer, the term of this patent is extended or adjusted under 35 U.S.C. 154(b) by 58 days.

(21) Appl. No.: 12/898,603

(22) Filed: Oct. 5, 2010

(65) Prior Publication Data

US 2011/0109481 A1 May 12, 2011

Related U.S. Application Data

(60) Provisional application No. 61/248,641, filed on Oct. 5, 2009.

(51) Int. Cl.
*G08G 5/04* (2006.01)
*G08G 5/06* (2006.01)

(52) U.S. Cl.
CPC ..... *G08G 5/06* (2013.01)
USPC ..... 340/961; 340/963; 340/972; 701/120; 701/301

(58) Field of Classification Search
USPC ..... 340/961, 963, 972; 701/120, 301
See application file for complete search history.

(56) References Cited

U.S. PATENT DOCUMENTS

| | | | | |
|---|---|---|---|---|
| 7,564,372 | B1 * | 7/2009 | Bailey et al. | 340/961 |
| 7,646,313 | B2 * | 1/2010 | Winkler et al. | 340/961 |
| 7,747,360 | B2 * | 6/2010 | Canu-Chiesa et al. | 701/3 |
| 7,772,992 | B2 * | 8/2010 | Fetzmann et al. | 340/961 |
| 7,962,279 | B2 * | 6/2011 | Pepitone et al. | 701/120 |
| 2007/0067093 | A1 * | 3/2007 | Pepitone | 701/120 |
| 2008/0191942 | A1 * | 8/2008 | Smith et al. | 342/456 |
| 2011/0169665 | A1 * | 7/2011 | Palanisamy et al. | 340/961 |

* cited by examiner

*Primary Examiner* — Brent Swarthout
(74) *Attorney, Agent, or Firm* — Allen J. Moss; Squire Patton Boggs (US) LLP

(57) ABSTRACT

Embodiments of the present invention relate to avionics systems, and more particularly, to collision avoidance systems. In one embodiment, a system is delineated comprising a plurality of detection zones for a plurality of aircraft and means for issuing a report based on one or more of the plurality of detection zones.

11 Claims, 2 Drawing Sheets

SYSTEMS AND METHODS USING MULTIPLE ZONES OF DETECTION AS A FUNCTION OF ACCURACY

CROSS REFERENCE TO RELATED APPLICATIONS

This application is related to and claims priority from U.S. Provisional Patent Application No. 61/248,641, filed on Oct. 5, 2009 in the names of the same inventors and entitled "SYSTEMS AND METHODS USING MULTIPLE ZONES OF DETECTION AS A FUNCTION OF ACCURACY," which is hereby incorporated by reference.

BACKGROUND OF THE INVENTION

1. Field of the Invention

The present invention relates to avionics systems, and more particularly, to collision avoidance systems.

2. Description of the Related Art

Previously proposed systems for runway safety alerting compare reported aircraft positions to a fixed "region of interest", such as an area around a runway, to determine if the aircraft is on the runway or not. Position inaccuracies, which are inherent to aircraft navigation systems, must be taken into account when the region of interest is defined. Systems that use a single region of interest for all aircraft, regardless of their individual navigation accuracy, use a "one size fits all" approach that is necessarily a compromise for a wide range of aircraft position accuracies.

SUMMARY OF THE INVENTION

In accordance with an embodiment of the present invention, a system is disclosed comprising a plurality of detection zones for a plurality of aircraft and means for issuing a report based on one or more of the plurality of detection zones.

It is to be understood that both the foregoing general description and the following detailed description are exemplary and explanatory only and are not restrictive of the invention, as now or later claimed.

The accompanying drawings, which are incorporated in and constitute a part of this specification, illustrate several embodiments of the invention and together with the description, serve to explain the principles of the invention.

DESCRIPTION OF THE EMBODIMENTS

Reference will now be made in detail to the present exemplary embodiments of the invention, an example of which are illustrated in the accompanying drawings.

The present invention uses different Detection Zones for different aircraft, based on their individual reported level of positional accuracy. This approach is particularly well suited to an environment where position accuracy is reported in quantized levels (such as with NACp values used in ADS-B).

The method of selecting one of a set of detection zones based on the reported accuracy, and having the size of each detection zone a function of the accuracy level is a means to account for the uncertainty in the reported position. By having the detection zone for each progressively worse level of navigation accuracy farther beyond the hold line (i.e. closer to the runway), a system can ensure that a nominal level of certainty (such as 99.99%) is obtained before declaring that a given vehicle is "on the runway". This ensures that the rate of occurrence of nuisance alerts is managed (such as 1 in 10,000 operations) regardless of navigation accuracy, while still generating valid alerts in as timely a manner as possible.

In one embodiment, the determination if one vehicle (such as own ship) is on the runway is made with a probability-based algorithm while the determination if another vehicle (such as a second aircraft) is on the runway uses the above method of comparing the reported position to one of a set of detection zones. This approach takes advantage of the higher resolution of navigation accuracy available on own ship while minimizing the computational complexity for processing the potentially large number of other vehicles operating in the vicinity of the airport. For instance, a GPS system reports positional accuracy through the Horizontal Figure of Merit which typically has a resolution of 0.031 m. In contrast, ADS-B reported accuracy levels (reflected in NACp), have discrete values such as 3 m, 10 m and 30 m.

Figure 1:
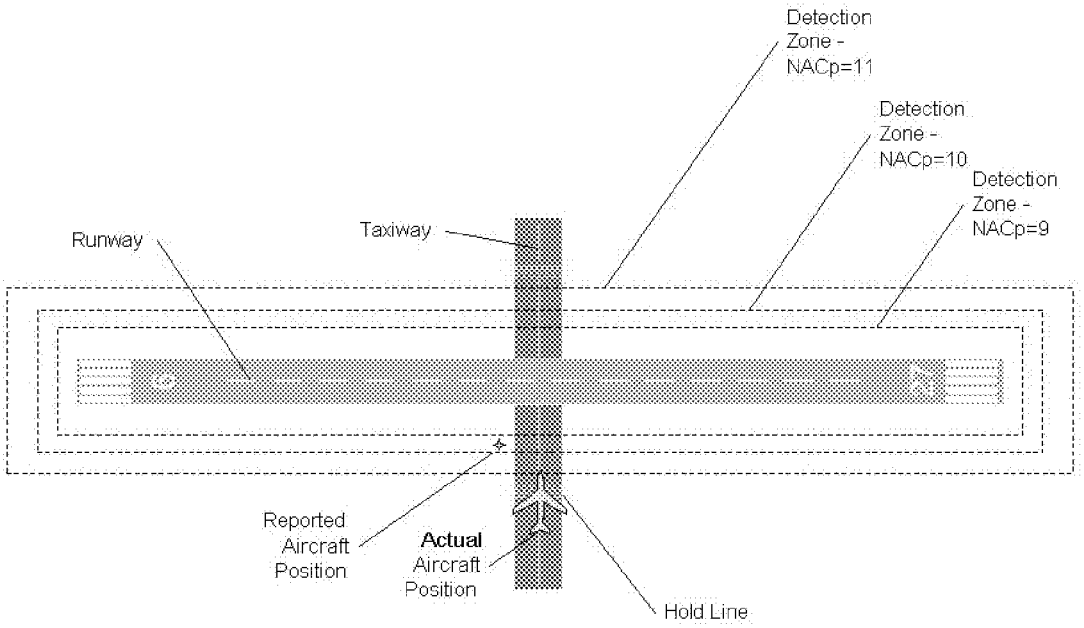
FIG. 1 is a simplified plan view of a system, in accordance with systems and methods consistent with the present invention.
Figure 2:
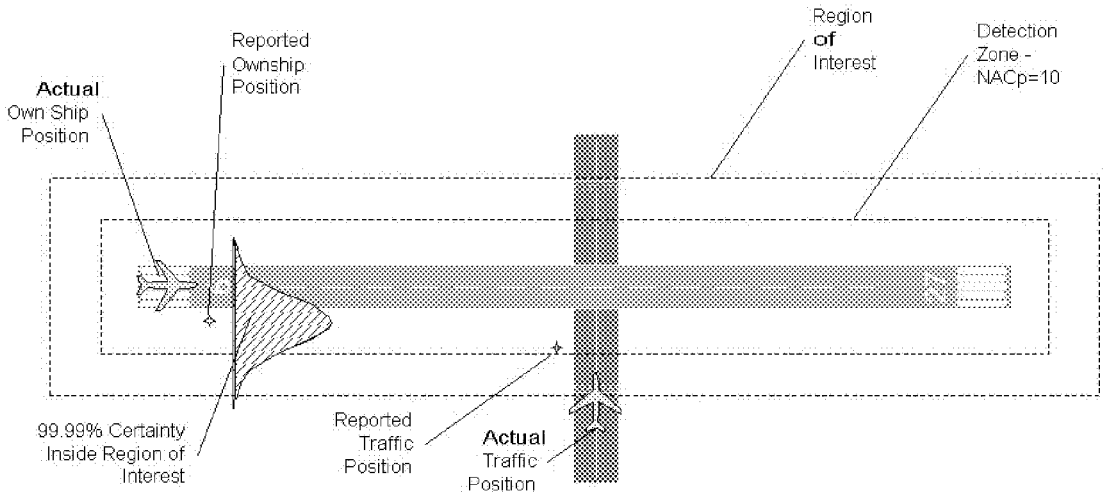
FIG. 2 is a simplified plan view of a system, in accordance with systems and methods consistent with the present invention.

FIG. 2 illustrates an embodiment described above. Based on a comparison of own ships position and a Region of Interest a determination is made as to whether or not there is the required level of certainty that the actual position of own ship is on the runway, the region of interest having essential the same boundary as an area on the surface of the airport corresponding to the runway and the portion of the taxiways inside the hold lines.

Additionally, the reported position of each traffic vehicle is then compared to the appropriate detection zone, where the detection zone lies essentially inside the boundary of the Region of Interest. No probabilistic calculation would be required to make this determination, as the buffer between the Detection Zone and the Region of Interest would effectively account for the position uncertainty.

In another embodiment, the system determines the minimum level of positional accuracy required to support the runway alerting function. This minimum level of accuracy may be based on factors such as the distance between the hold lines and the runway, the size of aircraft operating at the airport, etc.

In yet another embodiment, the system would define the location of the various Detection Zones based on the assumed accuracy levels associated with a given Navigation Accuracy Category for Position (NACp).

In still another embodiment the location of the various Detection Zones would be a based on a combination of the reported database accuracy for the runway and the assumed accuracy for a given NACp value.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system, comprising:

an avionics system configured to use a plurality of detection zones for a plurality of aircraft, wherein each detection zone is different and each is established based on a different accuracy level associated with a position report, wherein the plurality of detection zones are concentrically arranged around a runway; and a collision avoidance system configured to issue a report based on one or more of the plurality of detection zones.

2. The system of claim 1 wherein each accuracy level is based on a different NACp value.

3. The system of claim 2 wherein each position report has associated therewith a related NACp value.

4. The system of claim 1 wherein the report is based on a single detection zone.

5. The system of claim 4 wherein the single detection zone corresponds to a NACp value associated with a position report.

6. A method, comprising:

determining, by an avionics system, an own aircraft location to be on a runway;

determining, by the avionics system conditional the own aircraft location being on the runway, a position of a vehicle with respect to the runway based on comparing a reported position of the vehicle to a set of detection zones; and selecting a detection zone of the set of detection zones based on an accuracy level of the reported position.

7. The method of claim 6, wherein the set of detection zones are concentric around a runway.

8. The method of claim 6, wherein the detection zone is selected having a size correlated to the accuracy level, with higher levels of accuracy corresponding to larger detection areas.

9. The method of claim 6, wherein a larger detection zone is selected when the reported position is reported with global positioning system resolution than when the reported position is reported with an ADS-B resolution.

10. The system of claim 1, wherein a shape of at least one of the detection zones is based on the shape of at least one runway.

11. The system of claim 6, wherein a shape of at least one detection zone of the set of detection zones is based on the shape of at least one runway.

* * * * *